US007010842B2

(12) United States Patent
Lucas

(10) Patent No.: US 7,010,842 B2
(45) Date of Patent: Mar. 14, 2006

(54) METHOD OF SETTING GROMMETS IN A TARP

(76) Inventor: Mark Lucas, 222 Main Street, Waterford Ontario (CA) N0E 1Y0

( * ) Notice: Subject to any disclaimer, the term of this patent is extended or adjusted under 35 U.S.C. 154(b) by 0 days.

(21) Appl. No.: 10/823,897

(22) Filed: Apr. 14, 2004

(65) Prior Publication Data

US 2005/0066511 A1 Mar. 31, 2005

Related U.S. Application Data

(62) Division of application No. 10/156,606, filed on May 23, 2002, now Pat. No. 6,745,461.

(30) Foreign Application Priority Data

May 29, 2001 (CA) ..... 2349105

(51) Int. Cl.
*B23P 19/00* (2006.01)

(52) U.S. Cl. ..... 29/432; 29/509; 29/525.01; 29/798; 29/243.5

(58) Field of Classification Search ..... 29/432, 29/509, 525.01, 798, 243.5; 280/47.34; 414/426, 414/433; 242/160.1, 160.4, 387, 390.2, 403, 242/557

See application file for complete search history.

(56) References Cited

U.S. PATENT DOCUMENTS

| | | | |
|---|---|---|---|
| 3,579,773 | A | 5/1971 | Zysman |
| 4,429,456 | A | 2/1984 | Zahn |
| 4,685,408 | A | 8/1987 | Frye |
| 5,214,843 | A | 6/1993 | Bromley et al. |
| 5,282,303 | A | 2/1994 | Schriever |
| 5,488,767 | A | 2/1996 | Franovick |

*Primary Examiner*—David P. Bryant
*Assistant Examiner*—Jermie E. Cozart
(74) *Attorney, Agent, or Firm*—Gerald E. Hespos; Anthony J. Casella

(57) ABSTRACT

The invention relates to a method for setting grommets around the perimeter of a tarp. The method uses an apparatus with a feed reel from which a rolled tarp may be unwound; a table, across which a said tarp may be drawn; a take-up reel, onto which a the tarp may be rolled; and a grommet setter positioned relative to the table to permit an operator to set grommets on a the tarp as the tarp is drawn across the table.

1 Claim, 5 Drawing Sheets

METHOD OF SETTING GROMMETS IN A TARP

This application is a divisional of U.S. patent application Ser. No. 10/156,606 filed May 23, 2002 now U.S. Pat. No. 6,745,461.

BACKGROUND OF THE INVENTION

1. Field of the Invention

The present invention relates to a method and apparatus for setting grommets onto large textile sheets at high speed.

2. Description of the Related Art

Conventionally, grommets are set around the perimeter of a tarp, tent, or the like sheet material with the use of a grommet setter. A grommet setter is a machine that punches a hole in a textile, and sets a grommet into the hole in one operation. The grommet setter may be of the sort in which grommets are fed into the setting apparatus one at a time by hand, by an operator, or it may be auto-loading, wherein a number of grommets are inserted into a magazine and feed one at a time into the grommet setting apparatus as it is used. The grommet setting machine, be it manual loading or auto-loading, is conventionally firmly bolted to a work bench and substantially immovable. Therefore, when an operator is setting grommets around the perimeter of a large tarp (for instance) most of the time and effort of the operator is devoted to manually shifting the bulk of the tarp in a single rotational movement so that its perimeter edge can be brought into engagement with the grommet setter. The entire tarp must then be flattened out in a large space, and rolled or folded for further processing or shipping.

It will be appreciated, therefore, that the production capability of an experienced operator with a conventional grommet setting machine will be about three tarps a day. Using the present invention production is substantially facilitated, and production rates increase to about 20 units per day.

SUMMARY OF THE INVENTION

In a abroad aspect the present invention relates to an apparatus for setting grommets around the perimeter of a tarp, including: a feed reel from which a rolled tarp may be unwound; a table, across which a said tarp may be drawn; a take-up reel, onto which said tarp may be rolled; and a grommet setter positioned relative to said table to permit an operator to set grommets on said tarp as said tarp is drawn across said table.

In another broad aspect, the present invention relates to a method of setting grommets around the perimeter of a tarp, including the steps of: folding said tarp in two, lengthwise; winding said folded tarp onto a feed reel until a first end edge of said tarp is left unwound; setting grommets along the first end edge of the tarp, using a grommet setter mounted for rotation relative to a table; rotating said grommet setter 90 degrees to align the grommet setter with the edge of said table; unwinding said tarp onto said table part of said grommet setter, and setting grommets on the exposed edges of said tarp; winding said tarp onto a take-up reel so that the second end edge of said tarp is exposed; rotating said grommet setter to face said second edge; and setting grommets along said second edge of said tarp.

DETAILED DESCRIPTION OF THE PREFERRED EMBODIMENTS

Figure 1:
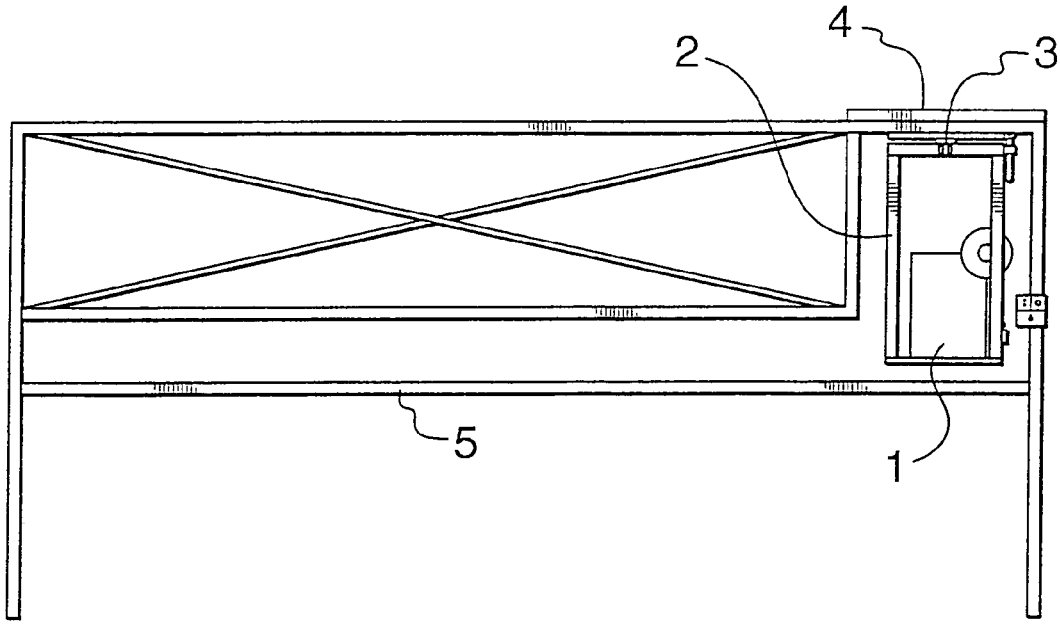
FIG. 1 is a front view of the work station of the present invention.
Figure 2:
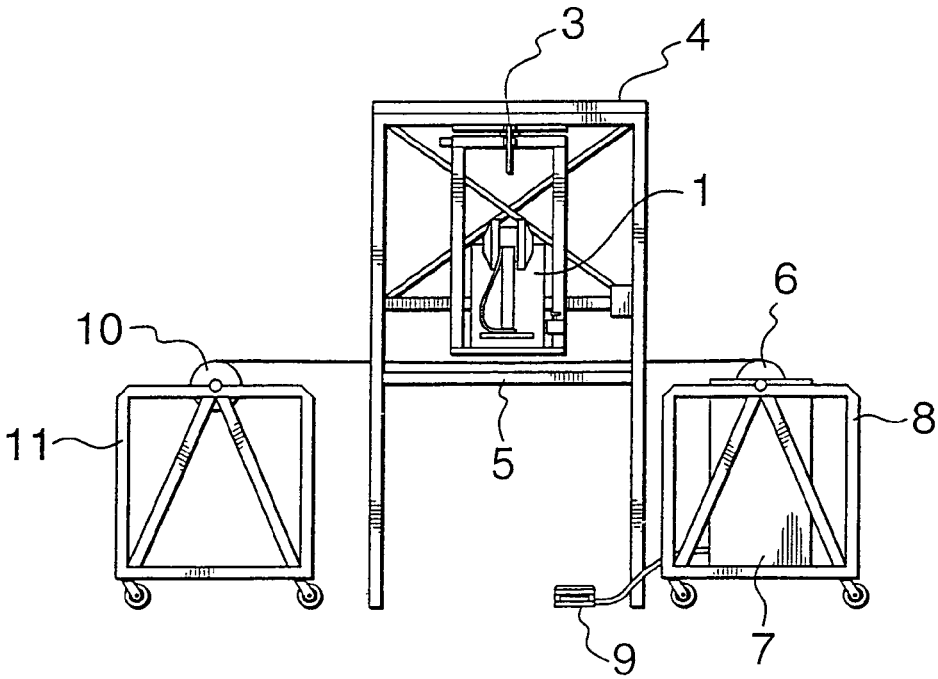
FIG. 2 is a side view of the work station of the present invention.

Referring now to the drawings, the present invention provides a work station including a grommet setter 1 that is preferably of the auto-loading type.

Grommet setter 1 is mounted in a frame 2 that is rotatable on a turntable 3 that is located above frame 2 on a superstructure 4.

Figure 3A:
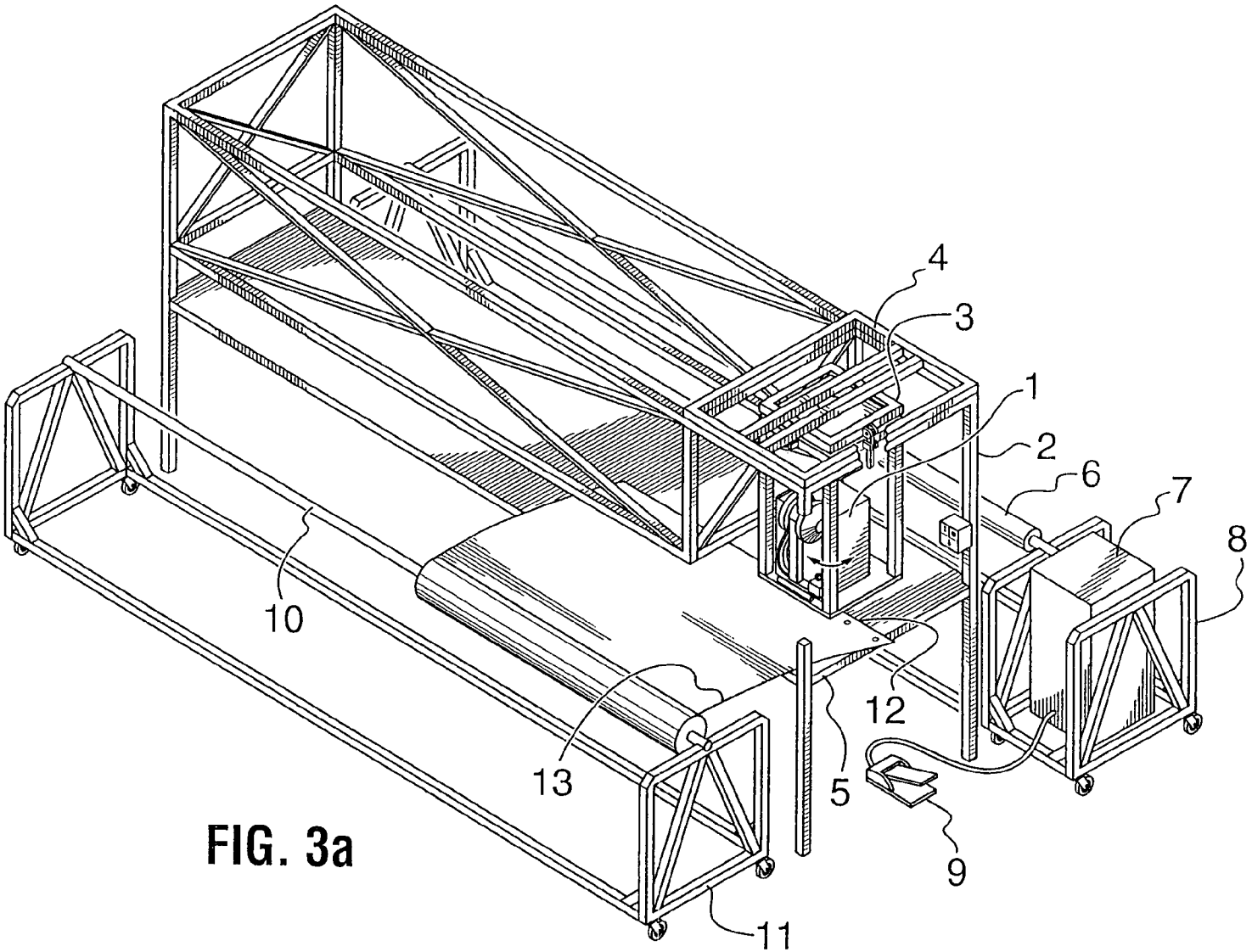
FIG. 3A is a first perspective view of the work station of the present invention.
Figure 3B:
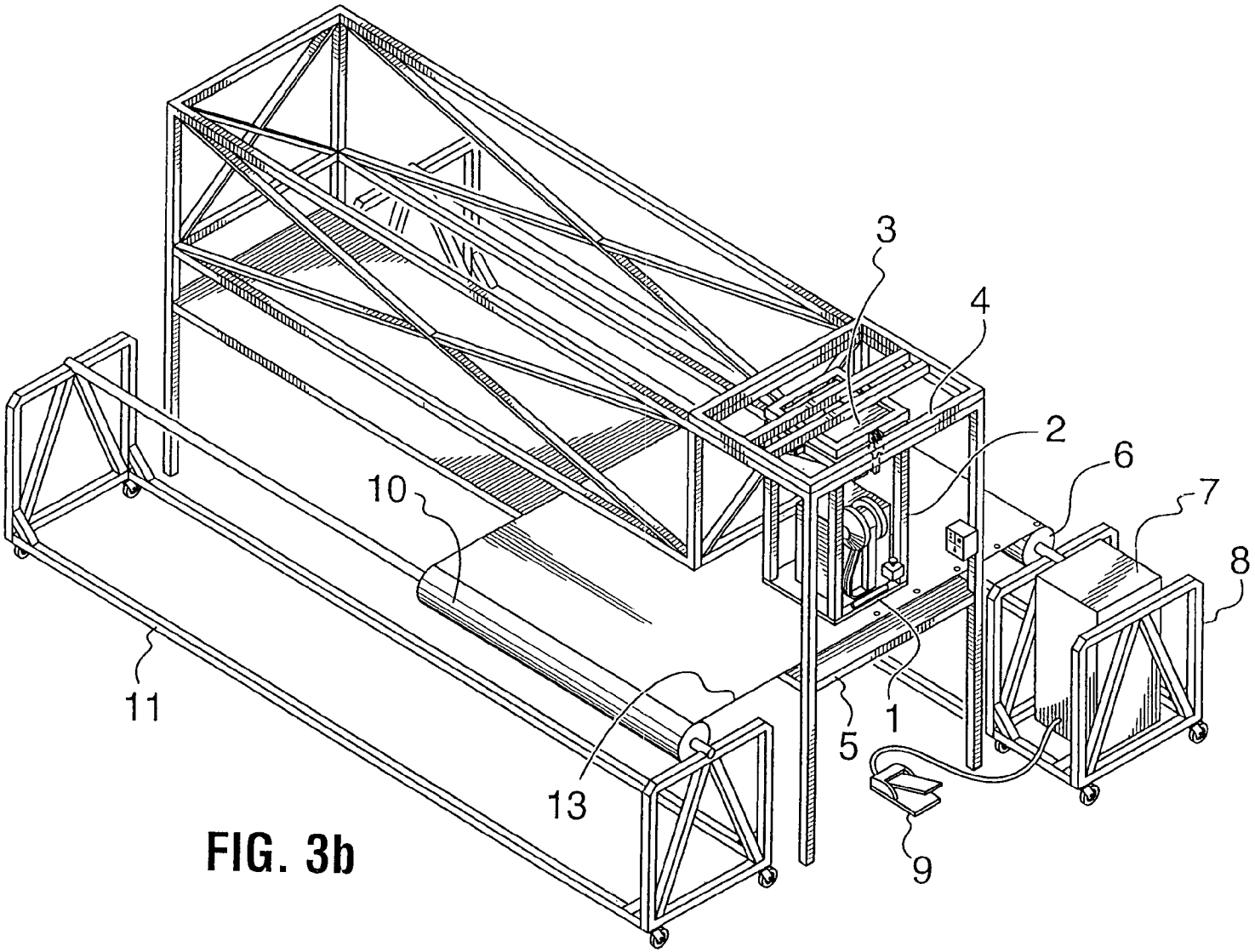
FIG. 3B is a second perspective view of the work station of the present invention.
Figure 4:
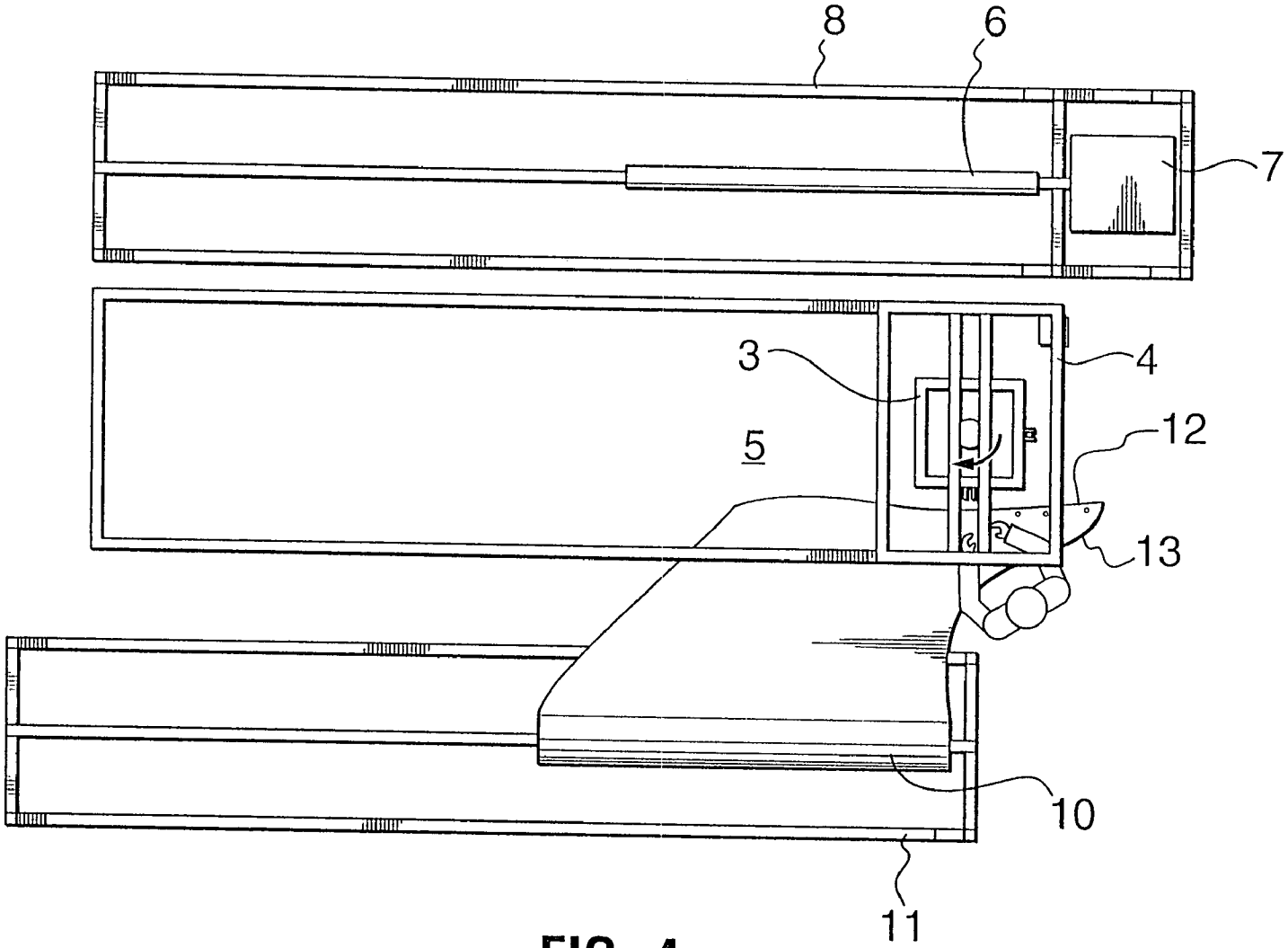
FIG. 4 is a top view of the work station of the present invention, showing grommet setting of an end edge of a tarp.

The superstructure 4, which is a supporting framework for the entire workstation, includes a table area 5 which may if desired be provided with rollers (not illustrated) for ease of pulling material over it. The table is fairly wide from side to side, as shown in FIGS. 3A to 5, to accommodate wide tarps, but fairly shallow from front to back, so that the grommet setter 1 can be rotated for use at the back of the table, as shown in FIG. 4, at the side, as shown in FIG. 5, or at the front of the table (not illustrated).

Figure 5:
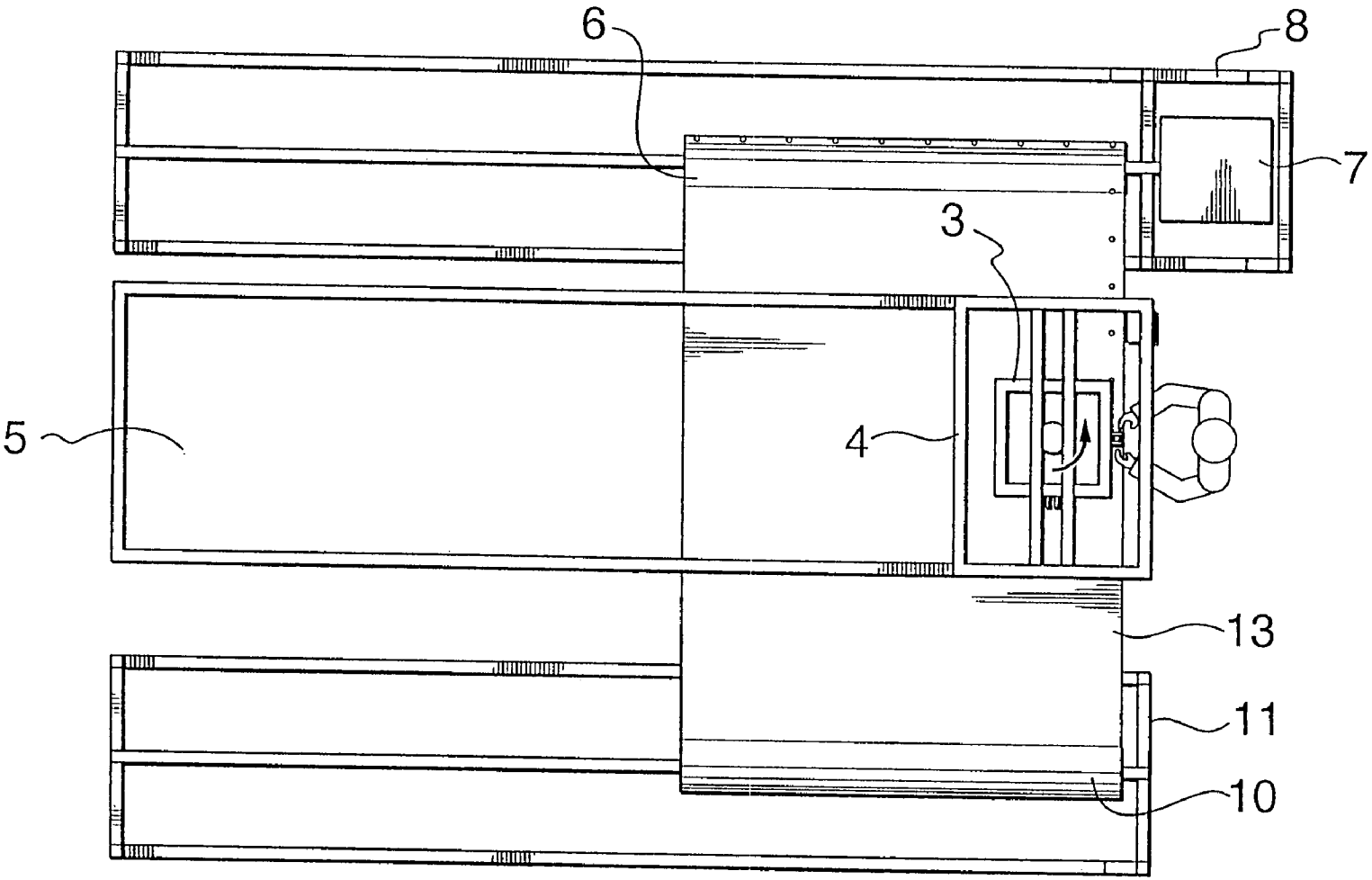
FIG. 5 is a top view of the work station of the present invention showing grommet setting of the side edges of a tarp.

The work station also include a take-up reel 6 mounted on a frame 8 that is provided with an electric motor 7 operable by an operator standing at the side of the work station, as shown in FIG. 5. The motor 7 is controlled by a foot pedal switch 9 at the side of the work station.

The work station further includes a feed reel 10 mounted on a frame 11. Frames 8 and 11 are on wheels so as to be maneuverable on a factory floor.

Utilizing the apparatus of the present invention, grommets are set around the perimeter of a tarp as follows:

1. A tarp is folded in tow, and rolled onto feed reel 10. The fold is located on the end of the reel that will be located away from the grommet setter.
2. As shown in FIG. 4, the grommet setter is rotated on turntable 3 to face the rear of the table 5.
3. The operator then sets grommets along the end edge 12 of the tarp, top and bottom layers of the folded tarp. To do this, the operator will unreel enough tarp from feed reel 10 to manipulate the entire end edge 12 of the folded tarp into engagement with grommet setter 1.
4. As shown in FIGS. 3B and 5, the grommet setter is then rotated to face the side of the table 5. The tarp is then pulled across the table, and wound onto take-up reel 6. As the side edges of the tarp are wound past grommet setter 1, by motor 7 operated by foot pedal 9, the operator sets grommets at the appropriate spacing along the side edges 13, of the top and bottom layers of the folded tarp.
5. When the entire tarp has been rolled onto take-up reel 6, the operator rotates the grommet setter to face the take-up reel, and then sets grommets in the trailing end edge of the tarp, in a manner similar to the way grommets were set in the leading end edge of the tarp.

At this point then, grommets have been set around the entire perimeter of the tarp, and it is reeled onto take-up reel 6, which can be removed from frame 8 for further processing, or the tarp can be unreeled, folded and packaged.

It will be observed that the present invention utilizes a substantially conventional grommet setter. Therefore, any known grommet setter may be adapted for use in the present invention. The present invention, moreover, shows a grommet setter in a frame suspended above a table 5 on a turntable 3 mounted on a superstructure. This is to permit the tarp or other textile fabric to be drawn past the grommet setter, so a space between the grommet setter and the table is required. It will be appreciated that without departing from the spirit of the present invention, the grommet setter may be inverted, and located under the table. Operation of the work station would be otherwise unchanged.

What is claimed is:

1. A method of setting grommets around the perimeter of a tarp, including the steps of:

i) folding said tarp in two, lengthwise;

ii) winding said folded tarp onto a feed reel until a first end edge of said tarp is left unwound;

iii) setting grommets along the first end edge of the tarp, using a grommet setter mounted for rotation relative to a table;

iv) rotating said grommet setter 90 degrees to align the grommet setter with the edge of said table;

v) unwinding said tarp onto said table of said grommet setter, and setting grommets on the exposed edges of said tarp;

vi) winding said tarp onto a take-up reel so that the second end edge of said tarp is exposed;

vii) rotating said grommet setter to face said second edge; and viii) setting grommets along said second edge of said tarp.

* * * * *